United States Patent [19]

Stephenson

[11] Patent Number: 5,028,239

[45] Date of Patent: Jul. 2, 1991

[54] FUEL DEWATERING ADDITIVES

[75] Inventor: William K. Stephenson, Sugar Land, Tex.

[73] Assignee: Nalco Chemical Company, Naperville, Ill.

[21] Appl. No.: 351,070

[22] Filed: May 12, 1989

[51] Int. Cl.[5] ..... C10L 00/00

[52] U.S. Cl. ..... 44/340; 44/388; 44/400; 210/708; 210/733; 210/734; 210/727; 208/188

[58] Field of Search ..... 44/62, 340, 388, 400; 208/188; 210/708, 727, 733, 734

[56] References Cited

U.S. PATENT DOCUMENTS

| | | | |
|---|---|---|---|
| Re. 28,567 | 10/1975 | Anderson et al. | 210/734 |
| 2,604,453 | 7/1952 | Popkin | 44/62 |
| 2,737,452 | 3/1956 | Catlin et al. | 44/62 |
| 2,952,590 | 11/1960 | Siegel | 44/62 |
| 2,982,628 | 5/1961 | Lusebrink et al. | 44/62 |
| 3,037,851 | 6/1962 | Scheule | 44/62 |
| 3,058,818 | 10/1962 | Michaels et al. | 44/62 |
| 3,069,245 | 12/1962 | Wythe et al. | 44/62 |
| 3,070,429 | 12/1962 | Fareri et al. | 44/62 |
| 3,141,745 | 7/1964 | Calvino | 44/62 |
| 3,142,664 | 7/1964 | Bauer | 44/62 |
| 3,147,222 | 9/1964 | Bauer | 44/62 |
| 3,166,508 | 1/1965 | Fields | 44/62 |
| 3,502,581 | 3/1970 | Cyba | 44/62 |
| 3,506,574 | 4/1970 | Slambaugh et al. | 44/62 |
| 3,803,034 | 4/1974 | Dasch | 44/62 |
| 3,812,034 | 5/1974 | Gaydasch | 44/62 |
| 4,026,794 | 5/1977 | Mauceri | 210/708 |
| 4,120,815 | 10/1978 | Raman | 210/708 |
| 4,182,689 | 1/1980 | Presley et al. | 210/725 |
| 4,405,015 | 9/1983 | McCoy et al. | 210/708 |
| 4,431,548 | 2/1984 | Lipowski et al. | 210/733 |
| 4,466,885 | 8/1984 | Ronden | 210/727 |
| 4,539,100 | 9/1985 | Ronden | 210/727 |
| 4,596,653 | 6/1986 | Graham et al. | 210/708 |
| 4,732,204 | 3/1988 | Lamb | 210/734 |
| 4,741,835 | 5/1988 | Jacques et al. | 210/734 |

*Primary Examiner*—Helane E. Myers
*Attorney, Agent, or Firm*—Kinzer, Plyer, Dorn, McEachran & Jambor

[57] ABSTRACT

A method of dehazing a contained body of petroleum distillate by removing suspended water droplets from the distillate phase, or releasing free water trapped in an emulsion settled from the distillate phase, a detergent having been added to the petroleum distillate, comprising the step of adding to the distillate an effective amount of a vinyl copolymer which includes both a hydrophilic and hydrophobic monomer.

3 Claims, 1 Drawing Sheet

FUEL DEWATERING ADDITIVES

BACKGROUND OF THE INVENTION

1. Field of the Invention

Figures 1A, 1B, 1C, 1D, 1E:
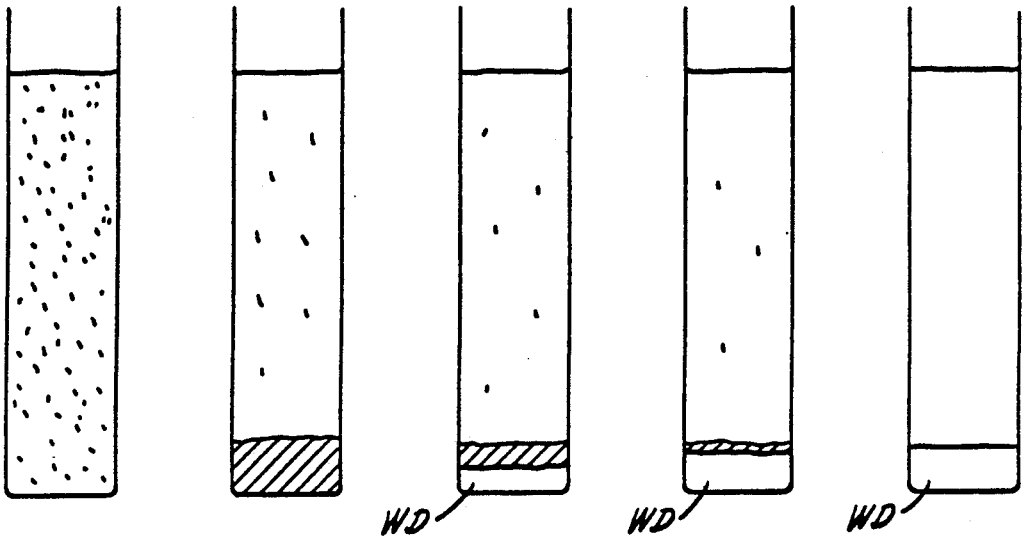
Figures 1F, 1G, 1H, 1I:
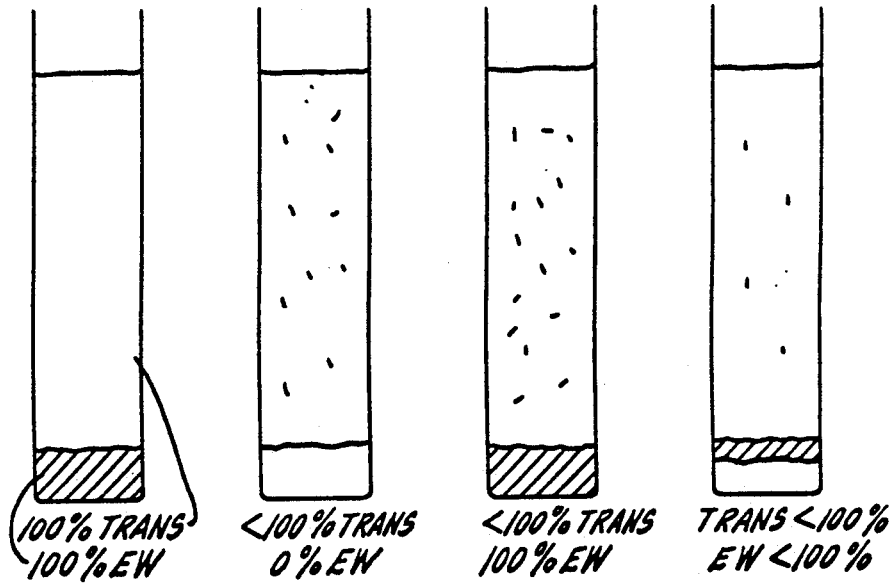

The invention relates to the field of additives for fuel dehydration, and more specifically, to additives for dehazing crude oil distillates and demulsifying separated water emulsions.

2. Description of the Prior Art

Detergents are often added to gasoline to improve engine performance and prevent fouling and deposits. These hydrophilic compounds sometimes serve to disperse water into the gasoline. Additives are therefore needed for water removal. In addition, the separated water may be emulsified (rather than exist as "free" water). Chemicals which dehaze petroleum fuel and demulsify separated water emulsions include phenolic resin alkoxylates, polyethers, hydroxylated resin acids.

SUMMARY OF THE INVENTION

The present invention deals with a new class of additives which dehaze or dewater gasoline and crude oil distillates. These novel additives are vinyl polymers made from one or more hydrophilic monomers and one or more hydrophobic monomers. For discussion purposes, the term "hydrophilic" refers to monomers for which the weight percent of heteroatoms (e.g., oxygen, nitrogen) is greater than or equal to about 27, and the term "hydrophobic" refers to monomers for which the weight percent of heteroatoms is less than about 27.

Effective polymers are found within a wide range of hydrophilic/hydrophobic weight ratios. Especially efficacious are those polymers with overall hydrophilic/hydrophobic weight ratios of 65/35 to 35/65, and polymers for which the overall weight percent of heteroatoms ranges from about 25.5 to 27.5.

DESCRIPTION OF THE PREFERRED EXPERIMENTS

It has been discovered that vinyl polymers are effective gasoline additives which dehaze or dewater water-contaminated gasoline and demulsify separated emulsified water. These polymers are made by free radical polymerization of one or more hydrophilic monomers and one or more hydrophobic monomers and have the general formula:

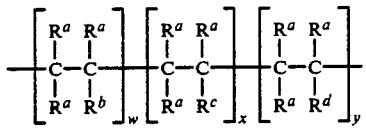

where $R^a$ is either hydrogen, methyl, or an alkyl group, and are represented by the general formula $C_nH_{2n+1}$, where n is zero or an integer greater than or equal to one; $R^b$, $R^c$, $R^d$ represent various functional groups consisting of hydrogen, carbon, and at least one heteroatom (e.g., oxygen, nitrogen) or unsaturated (e.g., phenyl) site and include those of the structure:

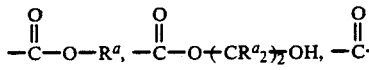

-continued

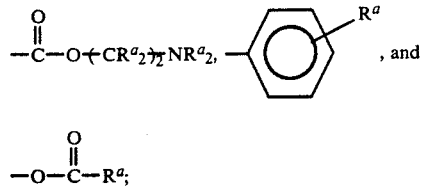

where "z" is an integer greater than or equal to one.

As examples, the above description of vinyl polymer gasoline additives would include: butyl acrylate/vinyl pyrrolidone copolymers; butyl acrylate/hydroxyethyl methacrylate/styrene, butyl acrylate/hydroxyethyl acrylate/methyl methacrylate, butyl methacrylate/butyl acrylate/hydroxyethyl methacrylate butyl acrylate/dimethylaminoethyl acrylate/hydroxyethyl methacrylate terpolymers; and acrylic acid/butyl acrylate/hydroxyethyl acrylate/styrene polymers; etc.

In addition, polymers can be made from monomers with two or more sites of vinyl unsaturation, such as allyl methacrylate (functionality=2) or pentaerythritol tetraacrylate (functionality=4). Monomers with two or more vinyl moieties may induce branching within a polymer or crosslinking between different polymer backbones. Examples include allyl methacrylate/butyl acrylate/hydroxyethyl acrylate/methyl methacrylate polymers and pentaerythritol tetraacrylate/butyl acrylate/vinyl pyrrolidone terpolymers.

As evident from the above examples, each polymer is made from one or more hydrophilic monomers (percent heteroatom by weight, PHA, is greater than or equal to 27) and one or more hydrophobic monomers (PHA<27). Calculation of monomer PHA values is based on atomic and molecular weights. For example, a molecule of dimethylaminoethyl acrylate has the formula $C_7H_{13}O_2N$ and a molecular weight of 143. The weight percent attributable to oxygen (2 atoms of atomic weight 16) and nitrogen (1 atom of atomic weight 14) heteroatoms is $(46/143)\times 100=32.2$.

Examples of hydrophilic monomers and hydrophobic monomers are shown in Table 1, as are the corresponding abbreviations and weight percent heteroatom (PHA) values. Molecules such as styrene are polar by nature of delocalized electrons, and hence they may participate in intermolecular polar interactions to a much greater extent than PHA values suggest. The fact that both dipolarity (such as might result from a carbon-heteroatom bond) and polarizability (such as might result from an aromatic ring) may contribute to the overall polarity of a molecule is well documented.

Polymer PHA values are calculated from the equation:

$$PHA_{polymer}=w_1\,PHA_1+w_2\,PHA_2+\ldots \quad (1)$$

where "1" and "2" denote monomers comprising the polymer formulation and "w" refers to the weight fraction. Hydrophilic/hydrophobic monomer weight ratios range from about 7/93 to 75/25. As the hydrophilicity of the hydrophilic monomer(s) decreases (i.e., as PHA approaches 27), a larger hydrophilic/hydrophobic monomer ratio may be necessary to maintain polymer performance. Polymers in the PHA range of about 25.5 to about 27.5 perform especially well. Preferred polymers include those in which vinyl pyrrolidone serves as a hydrophilic monomer.

The vinyl polymer additives are made from the free radical polymerization of vinyl-type monomers which posses sites of unsaturation. The area of free radical polymerization has been studied extensively and is well known in the science of chemistry. For the most part, the polymers for dewatering gasoline were made by a semibatch process in which most or all of the monomer charge was added over a 0.5–4 hour period to a reactor vessel containing solvent. As a typical case, consider the following example: To a reactor vessel (e.g., three neck flask) equipped with stirring and heating capabilities, add 138 parts of solvent and heat to 65°–75° C. To a separate vessel (reservoir), mix 1 part allyl methacrylate, 112 parts butyl acrylate, 19 parts hydroxyethyl acrylate, 7 parts methyl methacrylate, and 0.2 parts initiator. Add the contents of the reservoir (monomer plus initiator) to the reactor over a 0.5–3 hour period. Additional initiator may be necessary to reduce residual monomer content. The resulting polymers are liquids, often with weight average molecular weights <100,000. Reaction products typically have a polymer content of 40–50%. Modifications in the synthesis procedure may be required to accommodate special situations. For example, a monomer with a very low reactivity may be charged directly to the reactor (rather than the reservoir) to maximize incorporation and randomness. Batch conditions are not unreasonable providing the reaction exotherm is not prohibitive.

Polymer performance is evaluated by a "blender test" which is summarized as follows. 100 ml of a gasoline (usually containing a "detergent" package), 5 ml of water, and the polymer dewatering additive are mixed in a high speed Waring blender for 30 seconds. Additive dosage typically ranges from 15 to 60 ppm, but are sometimes reported in units of ptb (parts per thousand barrels). The resulting mixture is poured into a large graduated centrifuge tube. Turbidity (haze) measurements from an Emcee Electronics brand turbidimeter are recorded 2, 4, 6, 8 and 24 hours after the blending process. Also recorded are data which relates to the amount of water which separates from the fuel phase: a portion or all of the water which separates may be emulsified (corresponding to percent emulsifed water, %EW, values), or a portion or all of the water which separates may be "free" or non-emulsified (corresponding to the amount of water dropped, WD, values).

After 24 hours, the centrifuge tubes are inverted 10 times (i.e., reshaken) and additional turbidity and water drop measurements recorded. This "reshake" portion of the experiment simulates turbulent disturbances of fuel storage tanks.

These data, along with visual observations of the test samples, are used to evaluate overall polymer performance. Especially important parameters include: (1) turbidity of fuel phase, (2) amount of water separated, (3) interface properties, and (4) water quality. Tests results may vary according to the gasoline or fuel composition, water sample, amount of agitation, etc.

Several examples of the claimed gasoline dewatering additives are shown in Tables 2–6.

EXAMPLE 1

Sixty ppm of a 40% active butyl acrylate/vinyl pyrrolidone copolymer solution (BA/VP mass ratio=35/65) was added to 100 ml of gasoline containing a confidential detergent package and 5 ml of water. The mixture was agitated with a commercial Waring blender at high speed for 30 seconds. Blender contents were poured into a graduated centrifuge tube. Aliquots from the gasoline phase were periodically analyzed for percent transmittance (turbidity or haze readings) with a turbidimeter from Emcee Electronics. Polymer performance is shown in Table 2. After 8 hours, the percent transmittance recorded for the test sample was 96%, much better than the 83% obtained for the blank. The interface (emulsion phase or pad) was very loose and easily disturbed. Emulsion pads or interfaces sometimes have to be removed (vacuumed) from large commercial gasoline storage tanks such as those commonly found at retail gasoline stations, and a loose emulsion pad is much easier to remove than a tight, rigid emulsion pad.

EXAMPLE 6

To a flask was added 137 parts of aromatic solvent. Butyl acrylate (111 parts), hydroxyethyl methacrylate (19 parts), and methyl methacrylate (7 parts) were mixed in a separate vessel (reservoir). After the flask contents were elevated to about 75° C., the reservoir contents and 0.20 parts initiator were added to the flask over a 1–2 hour period. Following the monomer addition, an additional 0.11 parts of initiator was added to reduce residual monomer content. The reaction was terminated after about eight hours.

Blender test results are shown in Tables 2 and 4. In Table 4, the six hour transmittance for the 20 ptb dosage (87%) was better than for the analogous 10 ptb dosage (77%), and both were better than the blank (57%). Water drop (WD) reading refer to the amount of water which has clearly separated from both gasoline and the interface or emulsion phase (i.e., to the amount of "free" water). One hour after the "reshake," the 10 ptb and 20 ptb samples had dropped 2.7 ml and 3.8 ml of water (of a possible 5 ml), respectively.

EXAMPLE 10

A BA/VP/PETA terpolymer with respective weight percents 64/35/1 was placed in a Waring blender with 100 ml of gasoline containing a detergent package and 5 ml of water and blended for 30 seconds on high speed. The resulting mixture was poured into a large graduated centrifuge tube. The gasoline phase was periodically monitored for percent transmittance. After 24 hours, the centrifuge tubes were capped and inverted 10 times. This is referred to the "reshake" portion of the test and simulates a situation in which the contents of a bulk gasoline storage tank are agitated during the refilling process. The transmittance of the gasoline phase one hour after the "reshake" is shown in Table 3. Example 10 gave a 98% transmittance reading at 24 hours (vs. 78% for the blank) and excellent performance for the reshake portion of the test (58%, vs. 0% for the blank).

EXAMPLES 16–25

Blender test results for Examples 16 to 25 are shown in Table 5. In addition to gasoline phase transmittance values, percent emulsified water (%EW) values are reported. Because it is desired that water separated from gasoline remain "free" rather than emulsified, the optimum value for %EW is zero. After eight hours, Examples 16 (BA/DMAEA copolymer), 17 and 18 (BA/DMAEA/HEMA terpolymers), 23 (a BA/-HEMA/LA/EO alkoxylate), and 25 (a BA/-HEMA/EO alkoxylate) gave %EW values substantially less than the 100% value of the blank. These exemplify compounds which are resolving (demulsifying) the emulsion phase or interface, and which may prove very useful for situations in which emulsion phase resolution is of major concern. Examples 19 (BA/HEMA copolymer), 20 (BA/DMAEA/HEMA terpolymer), 21 (BA/HEA/EO alkoxylates), 22 (BA/VP copolymer), and 24 (BA/HEMA/EO alkoxylate) gave good dehaze values at the eight hour mark.

TABLE 1

SAMPLE MONOMERS

| MONOMER | ABBREVIATION | WT % HETEROATOM (PHA) |
|---|---|---|
| Acrylic acid | AA | 44.1 |
| Allyl methacrylate | AMA | 25.4* |

TABLE 1 -continued

SAMPLE MONOMERS

| MONOMER | ABBREVIATION | WT % HETEROATOM (PHA) |
|---|---|---|
| Vinyl acetate | VA | 37.2 |
| Vinyl pyrrolidone | VP | 27.0 |
| Butyl methyacrylate | BMA | 22.5* |

*Denotes hydrophobic monomer; remainder hydrophilic monomers

TABLE 2

BLENDER TEST RESULTS

| EXAMPLE NUMBER | POLYMER COMPOSITION | WEIGHT PERCENTS | POLYMER PHA | TRANS. 2 HR | TRANS. 4 HR | TRANS. 6 HR | TRANS. 8 HR |
|---|---|---|---|---|---|---|---|
| BLANK | | | | 44 | 54 | 66 | 83 |
| 1 | BA/VP | 35/65 | 26.3 | 53 | 64 | 79 | 96 |
| 2 | BA/VP | 50/50 | 26.0 | 19 | 48 | 56 | 74 |
| 3 | BA/VP | 65/35 | 25.7 | 0 | 45 | 58 | 71 |
| 4 | BA/HEMA/STY | 79/9/12 | 26.5 | 49 | 61 | 78 | 94 |
| 5 | BA/HEA/MMA | 93/5/2 | 25.9 | 50 | 62 | 77 | 93 |
| 6 | BA/HEA/MMA | 81/14/5 | 27.6 | 64 | 73 | 87 | 96 |
| 7 | AMA/BA/HEA/MMA | 1/80/14/5 | 27.5 | 58 | 75 | 90 | 98 |
| 8 | AA/BA/HEA/STY | 3/79/3/15 | 26.5 | 58 | 65 | 86 | 98 |
| 16 | BA/HMAcd | 93/7 | 27.9 | 45 | 62 | 59 | 68 |
| 17 | BA/VA | 87/13 | 26.5 | 43 | 48 | 68 | 74 |

(1) Optimum transmittance (TRANS) = 100%.
(2) Optimum water drop (WD) = 5 ml.
(3) Dosage = 60 ppm.
(4) Nos. 9 and 15 were inadvertently passed when numbering the examples It will be seen from Table 2 that examples 1 and 4 through 8 exhibited good dehazing properties, near 100% transmittance.

TABLE 3

BLENDER TEST RESULTS

| EXAMPLE NO. | POLYMER COMPOSITION | WEIGHT PERCENTS | POLYMER PHA | TRANS. 2 HR | TRANS. 4 HR | TRANS. 6 HR | TRANS. 24 HR | TRANS. SHAKE + 1 HR |
|---|---|---|---|---|---|---|---|---|
| BLANK | | | | 0 | 47 | 53 | 78 | 0 |
| 1 | BA/VP | 35/65 | 26.3 | 50 | 61 | 72 | 98 | 45 |
| 4 | BA/HEMA/STY | 79/9/12 | 26.5 | 48 | 55 | 64 | 93 | 0 |
| 7 | AMA/BA/HEA/MMA | 1/80/14/5 | 27.5 | 53 | 69 | 81 | 100 | 0 |
| 10 | BA/VP/PETA | 64/35/1 | 25.7 | 7 | 62 | 81 | 97 | 58 |
| 11 | BA/VP/PETA | 28.9/70.8/0.3 | 26.4 | 52 | 74 | 87 | 98 | 65 |
| 12 | BA/BMA/HEMA | 81/3/16 | 26.8 | 19 | 45 | 53 | 83 | 0 |
| 13 | BA/BMA HEMA/PETA | 80/3/16/1 | 26.9 | 0 | 41 | 51 | 79 | 0 |
| 14 | BA/DMAEA/HEMA | 84/11/5 | 26.5 | 46 | 52 | 65 | 93 | 0 |

(1) Optimum transmittance (TRANS) = 100%.
(2) Dosage = 60 ppm.

| | | |
|---|---|---|
| Butyl acrylate | BA | 25.0* |
| Dimethylaminoethyl acrylate | DMAEA | 32.2 |
| Ethylene oxide | EO | 36.4 |
| Hydroxyethyl acrylate | HEA | 41.4 |
| Hydroxyethyl methacrylate | HEMA | 36.9 |
| Hydroxymethyl acrylamide | HMAcd | 45.5 |
| Lauryl acrylate | LA | 13.3* |
| Methyl methacrylate | MMA | 32.0 |
| Pentaerythritol tetraacrylate | PETA | 36.4 |
| Styrene | STY | * |

It will be seen from Table 3 that the list of good dehazers (after 24 hours) is expanded to include examples 10, 11 and 14; of these 1, 10 and 11 are superior in that transmittance far exceeds the blank (zero) after the sample was shaken (inverted and reinverted) over a period of one hour. This feature of superiority is also evident from the data in Table 4, which adds example 13; and also example 12, though marginal.

TABLE 4

BLENDER TEST RESULTS

| EXAMPLE NO. | DOSAGE (ptb) | TRANSP 2 HR | TRANSP 4 HR | TRANSP 6 HR | TRANSP SHAKE + 1 HR | WD 4 HR | WD 6 HR | WD SHAKE + 1 HR |
|---|---|---|---|---|---|---|---|---|
| BLANK | | 35 | 48 | 57 | 0 | 0 | 0 | 0.0 |
| 1 | 10 | 55 | 64 | 78 | 45 | 0 | 0 | 1.3 |
| 1 | 20 | 52 | 67 | 82 | 0 | 0 | 0 | 3.7 |
| 6 | 10 | 49 | 64 | 77 | 0 | 0 | 0 | 2.7 |
| 6 | 20 | 60 | 72 | 87 | 0 | 0 | 0 | 3.8 |
| 7 | 10 | 54 | 63 | 80 | 0 | 0 | 0 | 2.8 |
| 7 | 20 | 58 | 76 | 87 | 0 | 0 | 0 | 4.0 |
| 8 | 10 | 30 | 56 | 63 | 0 | 0 | 0 | 3.0 |
| 8 | 20 | 57 | 66 | 84 | 0 | 0 | 0 | 4.0 |
| 10 | 10 | 31 | 65 | 81 | 43 | 0 | 0 | 3.6 |
| 10 | 20 | 52 | 74 | 83 | 46 | 0 | 0 | 4.0 |

TABLE 4-continued

| EXAMPLE NO. | DOSAGE (ptb) | TRANSP 2 HR | TRANSP 4 HR | TRANSP 6 HR | TRANSP SHAKE + 1 HR | WD 4 HR | WD 6 HR | WD SHAKE + 1 HR |
|---|---|---|---|---|---|---|---|---|
| | | BLENDER TEST RESULTS | | | | | | |
| 11 | 10 | 50 | 71 | 86 | 54 | 0 | 0 | 2.3 |
| 11 | 20 | 54 | 69 | 85 | 47 | 0 | 0 | 3.4 |
| 12 | 10 | 30 | 42 | 57 | 0 | 0 | 0 | 0.0 |
| 12 | 20 | 42 | 51 | 68 | 0 | 0 | 0 | 0.0 |
| 13 | 10 | 0 | 39 | 53 | 0 | 0 | 0 | 0.0 |
| 13 | 20 | 46 | 53 | 74 | 44 | 0 | 0 | 0.0 |

(1) Optimum transmittance (TRANS) = 100%.
(2) Optimum water drop (WD) = 5 ml.

TABLE 5

| EXAMPLE NO. | POLYMER COMPOSITION | WEIGHT PERCENTS | POLYMER PHA | TRANS 2 HR | TRANS 4 HR | TRANS 6 HR | TRANS 8 HR | % EW 2 HR | % EW 4 HR | % EW 6 HR | % EW 8 HR |
|---|---|---|---|---|---|---|---|---|---|---|---|
| | | | BLENDER TEST RESULTS | | | | | | | | |
| BLANK | | | | 0 | 41 | 57 | 63 | 100 | 100 | 100 | 100 |
| 16 | BA/DMAEA | 81/19 | 26.5 | 50 | 56 | 61 | 68 | 100 | 100 | 90 | 83 |
| 17 | BA/DMAEA/HEMA | 84/11/5 | 26.5 | 16 | 49 | 58 | 67 | 100 | 100 | 77 | 70 |
| 18 | BA/DMAEA/HEMA | 59/36/5 | 28.4 | 45 | 45 | 51 | 57 | 100 | 100 | 80 | 80 |
| 19 | BA/HEMA | 95/5 | 25.6 | 51 | 61 | 72 | 84 | 100 | 100 | 100 | 100 |
| 20 | BA/DMAEA/HEMA | 86/4/10 | 26.5 | 47 | 58 | 71 | 86 | 100 | 100 | 100 | 100 |
| 21 | BA/HEA/EO | 94/4/2 | | 50 | 52 | 67 | 79 | 100 | 100 | 100 | 100 |
| 22 | BA/VP | 85/15 | 25.3 | 52 | 61 | 72 | 80 | 100 | 100 | 100 | 100 |
| 23 | BA/HEMA/LA/EO | 49/9/37/5 | | 42 | 46 | 55 | 63 | 100 | 100 | 65 | 60 |
| 24 | BA/HEMA/EO | 84/11/5 | | 48 | 56 | 68 | 80 | 100 | 100 | 100 | 100 |
| 25 | BA/HEMA/EO | 58/7/35 | | 46 | 54 | 61 | 67 | 100 | 100 | 83 | 77 |

(1) Optimum transmittance (TRANS) = 100%.
(2) Optimum % emulsified water (% EW) = 0%; Maximum value is 100%.
(3) Dosage = 20 ptb.
(4) Water from Newburgh, NJ.

Examples 16–18, 23 and 24 exhibited good water dropout (WD) after eight hours, but were not good dehazers. Examples 19–22 and 24 were good dehazers but did not release trapped ("free") water from the settled-out oil-in-water emulsion (%EW). A combination of polymers may therefore be required when both dehazing and release of free water is required. Examples 27 and 28, Table 6 (BA/VP), both dehaze and demulsify, and are therefore most preferred.

TABLE 6

| EXAMPLE NO. | POLYMER COMPOSITION | WEIGHT PERCENTS | TRANS 2 HR | TRANS 4 HR | TRANS 24 HR | TRANS SHAKE + 1 HR | % EW 2 HR | % EW 4 HR | % EW 24 HR | % EW SHAKE + 1 HR |
|---|---|---|---|---|---|---|---|---|---|---|
| | | | BLENDER TEST RESULTS BUTYL ACTYLATE/VINYL PYRROLIDONE POLYMERS | | | | | | | |
| BLANK | | | 46 | 55 | 83 | 0 | 100 | 100 | 100 | 100 |
| 26 | BA/VP | 25/75 | 48 | 57 | 70 | 0 | 100 | 100 | 100 | 100 |
| 27 | BA/VP | 30/70 | 62 | 81 | 92 | 41 | 100 | 100 | 100 | 77 |
| 28 | BA/VP | 35/65 | 65 | 86 | 96 | 47 | 100 | 100 | 100 | 65 |
| 29 | BA/VP | 75/25 | 0 | 0 | 58 | 0 | 100 | 100 | 100 | 100 |
| 22 | BA/VP | 85/15 | 0 | 0 | 61 | 0 | 100 | 100 | 100 | 100 |
| 30 | BA/VP | 40/60 | 0 | 0 | 67 | 0 | 100 | 100 | 100 | 100 |
| 31 | BA/VP | 45/55 | 50 | 59 | 83 | 0 | 100 | 100 | 100 | 100 |
| 32 | BA/VP | 60/40 | 44 | 50 | 76 | 0 | 100 | 100 | 100 | 100 |

(1) Optimum transmittance (TRANS) = 100%.
(2) Optimum % emulsified water (% EW) = 0%; Maximum value is 100%.
(3) Dosage = 20 ptb.
(4) Water from Newburgh, NJ.

The drawing illustrates the progressive acting of the polymer action on a petroleum distillate (fuel containing a small amount of detergent for engine performance) under the present invention.

At stage A, the sample is 100 ml of detergent-containing gasoline to which has been added 5 ml of water, taken from the Waring blender (Example 1) and poured into a graduated tube. The dots in the drawing are water droplets; dispersed water per se and not an emulsion. The polymer (Butyl acrylate/Vinyl Pyrrolidone) is, of course, also present.

Stages B through E represent a progression of time. At B, most of the water (cross-hatch) has collected at (settled or dropped to) the bottom as an oil-in-water (o/w) emulsion; a little haze still remains. At stage C, the haze is even less, and the stage C emulsion has begun to release or drop free water so that now there are three phases: gasoline with a little haze, emulsified water and free water. At stage D, the emulsified water is further decreased in volume and the free water has increased in volume accordingly; the haze is near nil. At the final stage, stage E, no haze is apparent or noticeable; the emulsion has been resolved and the water phase is comprised of free water.

To further emphasize the phenomena involved, extremes are shown in the drawing at F, G, H and I. Case F illustrates good dehazing of the distillate phase, with poor demulsification of the water phase. Case G illustrates poor dehazing and good demulsification. Case H illustrates poor overall performance. Case I illustrates moderate dehazing and partial resolution of the water emulsion. Dehazing and demulsifying may or may not occur simultaneously; different degrees of effectiveness may be involved because the petroleum fuel distillate, taken with the source of water and the kind of detergent, renders the combination specific.

In practice, the vinyl polymer can be added along with the detergent when the tanker truck is filled with refinery gasoline, ready for the road trip. Of considerable commercial importance is the service station when the refinery gasoline is delivered to the underground storage tanks. As the storage tank is filled, the resulting turbulent flow conditions may cause water (either free or emulsified) at the bottom of the storage tank, if any is present, to disperse in the upper gasoline phase. To minimize this, the water phase may be periodically removed, usually by a vacuum system. It is therefore desired that the water phase be comprised of free or non-emulsified water, which is easier to remove than emulsified water. Of course, a loose emulsion given to flow will be much easier to vacuum from the storage tank than a rigid, tight emulsion.

Preferably, however, where there is a tendency for the oil-in-water emulsion to form (encouraged by the detergent which is present) the practice under the present invention will be to use a polymer (e.g. Example 23) which will encourage the release of free water and demulsification of the emulsion because the emulsion can sometimes harden to the point where it is very difficult to pump out, or even to the point where the attendant believes he has hit the bottom of the tank when in fact he has hit a cake of hard emulsion, possibly with free water underneath. Therefore, the practice should be to release as much free water as possible, especially since: (1) free water is easier to remove from storage tanks than emulsified water, (2) stabilization of the water phase emulsion requires surfactant, most likely detergent from the gasoline phase, and (3) the gasoline plus additive lost to the oil-in-water emulsion (drawing cross-hatch, phase B) may pose an environmental problem upon emulsion disposal.

It will be recognized that within the general formula set forth above there are numerous variations and modifications which would constitute equivalents for removing dispersed water droplets from the fuel. I have set forth the preferred example and of these the most preferred is Butyl acrylate/Vinyl pyrrolidone, Table 6, in weight ratio 35/65 which imparts the best transmittance, signifying almost complete water removal. Next in order of preference is the same copolymer in the weight ratio (monomer weight ratio) of 30/70. As noted above, performance can be specified depending upon the quality and nature of the fuel, the source of water and so on. For example, the dosages in Table 3 were 60 ppm but as can be seen from Table 4, the effective dosage for a particular fuel can be a matter of trial and error.

While I have shown and described several embodiments in accordance with my invention, it is to be clearly understood that the same are susceptible to numerous changes and modifications apparent to one skilled in the art. Therefore, I do not wish to be limited to the details shown and described, but intend to encompass all changes and modifications which come within the scope of the appended claims.

I claim:

1. A method of dehazing a contained body of petroleum fuel distillate incorporating surfactant for engine performance by settling therefrom suspended water droplets from the distillate phase, or releasing free water trapped in an emulsion settled from the distillate phase, comprising the step of adding to the surfactant-containing distillate an effective water dehazing amount of a vinyl polymer selected from the group consisting of Butyl acrylate/Vinyl pyrrolidone copolymer, Butyl acrylate/Hydroxyethyl methacrylate/Styrene terpolymer, Butyl acrylate/Hydroxyethyl acrylate/Methyl methacrylate terpolymer, Allyl methacrylate/Butyl acrylate/Hydroxyethyl acrylate/Methyl methacrylate polymer, Acrylic acid/Butyl acrylate/Hydroxyethyl acrylate/Styrene polymer, Butyl acrylate/Vinyl pyrrolidone/Pentaerythritol tetraacrylate terpolymer, Butyl acrylate/Butyl methacrylate/Hydroxyethyl methacrylate terpolymer, Butyl acrylate/Dimethylaminoethyl acrylate/Hydroxyethyl methacrylate terpolymer, Butyl acrylate/Butyl methacrylate/Hydroxyethyl methacrylate/Pentaerythritol tetraacrylate polymer, Butyl acrylate dimethylaminoethyl acrylate copolymer, Butyl acrylate/Dimethylaminoethyl acrylate/Hydroxymethyl acrylamide terpolymer, Butyl acrylate/Hydroxyethyl methacrylate copolymer, and Butyl acrylate/Dimethylaminoethyl acrylate/Hydroxymethyl acrylamide terpolymer, each of said copolymers including both a hydrophilic and hydrophobic monomer and subscribing to the general formula

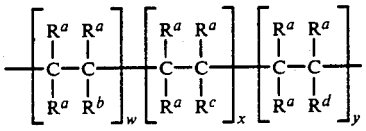

where $R^a$ is either hydrogen, methyl, or an alkyl group represented by the general formula $C_nH_{2n+1}$, where n is zero or an integer greater than one; where $R^b$, $R^c$, and $R^d$ represent functional groups each consisting of hydrogen, carbon, and at least one heteroatom or aromatic site of the structure:

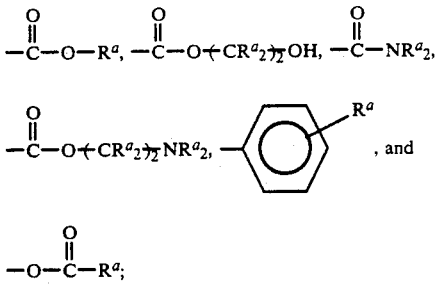

where z is an integer greater than or equal to one, wherein the hydrophilic/hydrophobic monomer fractions of the polymer are present in the weight ratio of about 7/93 to 75/25, wherein the overall heteroatom weight percent of the polymer is in the range of about 25.5 to 27.5 percent, and wherein the hydrophilic monomer of the polymer has heteroatoms constituting at least about 27 percent of the molecular weight of the copolymer and the hydrophobic monomer has heteroatoms constituting less than about 27 percent of the molecular weight of the polymer.

2. Method according to claim 1 wherein the distillate is gasoline in a tank.

3. Method according to claim 1 wherein the vinyl polymer is further reacted with an alkylene oxide to yield vinyl polymer alkoxylates, including Butyl acrylate/Hydroxyethyl acrylate/Ethylene oxide, Butyl acrylate/Hydroethyl methacrylate/Lauryl acrylate/Ethylene oxide and Butyl acrylate/Hydroxyethyl methacrylate/Ethylene oxide polymers.

* * * * *